US005525206A

United States Patent [19]

Wieczerniak et al.

[11] Patent Number: 5,525,206

[45] Date of Patent: Jun. 11, 1996

[54] BRIGHTENING ADDITIVE FOR TUNGSTEN ALLOY ELECTROPLATE

[75] Inventors: Walter J. Wieczerniak; Sylva Martin, both of Shelby Township, Mich.

[73] Assignee: Enthone-OMI, Inc., Warren, Mich.

[21] Appl. No.: 382,071

[22] Filed: Feb. 1, 1995

[51] Int. Cl.[6] ..... C25D 3/56; B22F 7/00; C09D 5/00; C09D 5/10

[52] U.S. Cl. ..... 205/238; 205/255; 205/259; 106/122; 106/125; 106/127

[58] Field of Search ..... 205/238, 255, 205/259; 106/1.12, 1.22, 1.25, 1.27

[56] References Cited

U.S. PATENT DOCUMENTS 4,529,668 7/1985 Croopnick et al. ..... 428/665
4,600,609 7/1986 Lever et al. ..... 427/438
5,389,226 2/1995 Scruggs et al. ..... 205/50

OTHER PUBLICATIONS

Air Products, "Surfynol® 400 Series", Liquid, Nonionic Surface–Active Agents, Surfynol 440, 465, and 485. (no date).

Chemax, Inc. Material Safety Data Sheet (no date).

*Primary Examiner*—John Niebling
*Assistant Examiner*—Edna Wong
*Attorney, Agent, or Firm*—Harness, Dickey & Pierce

[57] ABSTRACT

A brightening agent for use in tungsten alloy electroplating baths to replace hexavalent chromium plating or other hard lubrous coatings. Baths of the present invention comprise an effective amount of tungsten ions; an effective amount of a metal ion compatible with tungsten; one or more complexing agents; and an effective amount of a bath soluble alkoxylated hydroxy alkyne for providing brightening of a tungsten alloy electroplate.

20 Claims, No Drawings

BRIGHTENING ADDITIVE FOR TUNGSTEN ALLOY ELECTROPLATE

BACKGROUND OF THE INVENTION

The present invention relates to a brightening agent for use in Tungsten alloy electroplating baths to replace hexavalent chromium plating or other hard lubrous coatings.

Chromium plating for decorative and functional plating purposes has always been desirable. Most often chromium plating is carried out in hexavalent chromium electrolytes. Functional coatings from hexavalent chromium baths generally range in thickness from about 0.0002" to about 0.200" and provide very hard, lubrous corrosion resistant coatings. Decorative coatings from hexavalent chromium electrolytes, are much thinner, typically 0.000005" to 0.000030", and are desirable because of their blue-white color and abrasion and tarnish resistance. These coatings are almost always plated over decorative nickel or cobalt or nickel alloys containing cobalt or iron.

The imposition of government restrictions on the discharge of toxic effluent, including hexavalent chromium present in conventional chromium plating baths, has escalated in recent years. Some state and local government restrictions are extremely stringent. This is especially the case with regard to fumes generated during the electrolysis of hexavalent chromium baths. In some locales even minuscule amounts of airborne chromium is unacceptable. This has prompted the development of alternative electroplating baths intended to approach the color and the characteristics of chromium deposits.

One possible solution is the electrodeposition of tungsten alloys. Typically, in such baths, salts of nickel, cobalt, iron or mixtures thereof are used in combination with tungsten salts to produce tungsten alloy deposits on various conductive substrates. In this case the nickel, cobalt and/or iron ions act to catalyze the deposition of tungsten such that alloys containing as much as 50% tungsten can be deposited, said deposits having excellent abrasion resistance, hardness, lubricity and acceptable color when compared to chromium.

However, while such deposits have been desirable as replacements for chromium, the properties of resulting deposits and inherent manufacturing limitations in prior art processes have not allowed such deposits to replace decorative or functional chromium deposits. While alkaline complexed nickel tungsten co-deposits have been known, the deposits produced from these slightly alkaline ammoniacal electrolytes often have a rough nodular appearance in high current density areas. Thus, use of tungsten electroplates has required further processing steps in order to provide a chromium plate like surface.

Therefore, it has been desirable in the art to provide a tungsten alloy electroplate which does not form such rough nodular deposits but would have improved surface characteristics which would more readily allow replacement of chromium deposits with tungsten alloy electroplates without further processing.

SUMMARY OF THE INVENTION

In accordance with the aforementioned goals there is provided in accordance with the present invention an electrolyte for electroplating of a brightened tungsten alloy.

In accordance with the present invention there is provided an electrolyte for electroplating of a brightened tungsten alloy. The electrolyte bath of the present invention includes an effective amount of tungsten ions and also an effective amount of a metal ion or mixtures of metal ions which are compatible with the tungsten ions for electroplating of a tungsten alloy from the electrolyte. The electrolyte also includes one or more complexing agents to facilitate the electroplating of the tungsten alloy electroplate. It is critical in the present invention to provide an effective amount of a bath soluble alkoxylated hydroxy alkyne for providing brightening of the tungsten alloy electroplate when plated from the electrolyte.

Tungsten alloy electroplates when plated in accordance with the present invention provide brightened substrates even in high current density areas. The resultant electroplates are finer grained and brighter than with prior art methods.

Further benefits and advantages of the present invention will be readily realized by those skilled in the art upon review of the description of the preferred embodiments, examples and claims set forth below.

DETAILED DESCRIPTION OF THE PREFERRED EMBODIMENTS

In accordance with the broad aspects of the present invention an electrolyte bath for electroplating of a brightened tungsten alloy is provided. The electrolyte includes an effective amount of tungsten ions and metal ions, which are compatible with tungsten, for electroplating an alloy with tungsten from the electrolyte. One or more complexing agents are provided in the electrolyte for facilitating the plating of the tungsten alloy from the electrolyte. As a critical component of the present invention an effective amount of a bath soluble alkoxylated hydroxy alkyne is included in the electrolyte.

Typically, an electrolyte, in accordance with the present invention, includes from about 4 to about 100 g/l tungsten ions in the electrolyte, and preferably from about 25 to about 60 g/l tungsten ions. Tungsten ions are provided in the bath, as is known to those skilled in the art, in the form of salts of tungsten such as sodium tungstate or the like.

Metals, which are compatible for plating with tungsten, for forming tungsten-metal alloy electroplates include iron, cobalt, and nickel, with nickel being a preferred constituent in the present invention. These metal constituents require solubility in the electrolyte and therefore sulfates or carbonate salts of the selected metal are typically utilized. Generally, ranges of from about 1 to about 150 g/l of the metal additive salt are used in the subject invention. However, preferred ranges for nickel ion concentration in the electrolyte are from about 3 g/l to about 7 g/l of the nickel ion. The nickel or other bath constituent is necessary in the tungsten plating electrolytes in that it acts as a catalyst which enables the tungsten to plate from the solution.

Complexing agents useful in the present invention include those commonly used in other electroplating electrolytes such as citrates, gluconates, tartrates and other alkyl hydroxy carboxylic acids. Generally, these complexing agents are used in amounts of from about 10 to about 150 g/l with preferred amounts in the present bath being from about 45 to about 90 g/l. In a preferred electrolyte of the present invention a source of ammonium ions is provided in addition to one or more of the above complexing agents. The source of ammonium ions stimulates plating of tungsten from the bath and helps keep the metals in solution during plating. Preferred quantities of ammonium ions in the baths of present invention include from about 5 to about 20 g/l ammonium ions. The ammonium ions may be provided in different forms with ammonium hydroxide being a preferred agent. Of course ammonium ions may also be provided in a compound such as nickel ammonium citrate when used in the present electrolyte.

For effective electroplating, electrolytes of the present invention are maintained at a pH of from about 6 to about 9 with typical ranges of pH being from about 7 to about 8.5. The electrolyte of the present invention is useful at temperatures of from about 70° F. to about 190° F. with preferred operating temperatures of the present electrolyte being from about 110° F. to about 160° F.

Critical to the brightening aspects of the present invention is a brightening agent which comprises an alkoxylated hydroxy alkyne. Thus, the brightening agent of the present invention has the general formula:

$$(R_1)_x—C{\equiv}C—(R_2)_y$$

wherein $R_1$=H, an alkyl group or an alkoxy alcohol $R_2$=H, an alkyl group or an alkoxy alcohol and at least $R_1$ or $R_2$ is an alkoxy alcohol containing 1–4 carbon moieties including mixtures of these moieties which are included in ranges of from 1–100 moles of the alkoxy x and/or y.

Thus, the above formula includes compositions wherein both $R_1$ and $R_2$ may be found in the composition in amounts of from 1–100 moles or only one or the other is found in this amount. Preferably, the alkoxy alcohol moieties are from 1–4 carbons and may include several different moieties in this range in one molecule.

The alkoxylated hydroxy alkyne is preferably selected from the group consisting of: alkoxylated butyne diols, alkoxylated propargyl alcohols, alkoxylated dodecynediols, alkoxylated octyne mono or di alcohols, alkoxylated tetramethyl decyne diol, alkoxylated di methyl octyne diol and mixtures of these. A particularly preferred constituent for brightening in the present invention has the formula:

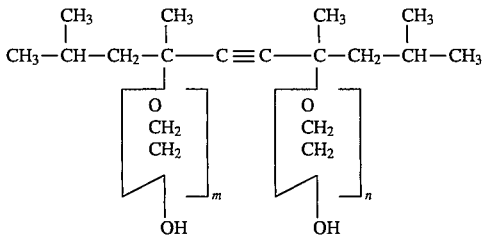

wherein m+n is selected to be at least a number of moles of ethylene oxide effective to provide solubility in the electrolyte. With respect to the above formula generally m+n equals from about 10 to about 100. A particularly preferred brightening agent is realized where m+n equals about 30.

Generally, the alkoxylated hydroxy alkyne brightening agent of the present invention is present in the bath in amounts of from about 1 mg/l to about 10 g/l. Typically, the brightening agent is present in amounts of from about 3 mg/l to about 1 g/l with preferred amounts being from about 5 mg/l to about 500 mg/l.

With the use of the brightening agent in the present invention bright tungsten alloy electroplating of parts can be accomplished with current densities of generally from about 1 to about 125 amps per square foot (ASF) with preferred operating currents for electroplating current of from about 60 to about 80 ASF. Parts plated from the present invention demonstrate much better leveling characteristics and smaller grain sizes than those previously accomplished. The deposits are bright, even in high current density areas.

Deposits of the present invention may be used as a suitable replacement for chrome plates without the requirement of machining steps. Deposits of the present invention are particularly useful for functional applications such as platings on shafts of shock absorbers, engine valves, transmission parts hydraulic cylinder surfaces and a plethora of other applications commonly utilizing chromium electroplates.

Further understanding of the present invention will be had by reference to the following examples, which are presented herein for purposes of illustration but not limitation.

EXAMPLE I

An aqueous (1 liter) electroplating bath is prepared in accordance with Table 1 set forth below:

TABLE 1

| Constituent | Amount |
|---|---|
| nickel metal* | 3 g/l |
| tungsten metal** | 50 g/l |
| ammonium citrate | 75 g/l |
| butyne diol with 2 moles ethylene oxide | 4 mg/l |

*from nickel sulfate
**from sodium tungstate

The bath was adjusted to and maintained at a pH of from about 7 to about 8 and was maintained at a temperature of 120° F. A series of steel cathodes were plated with current densities ranging from 1 to 80 ASF. Deposits plated from this bath demonstrated commercially acceptable electroplates in current density ranges of from 1 to 80 ASF. Tungsten content in the resulting deposit is 38% by weight.

EXAMPLE II

An aqueous (1 liter) electroplating bath is prepared in accordance with Table II below.

TABLE II

| bath constituent | amount |
|---|---|
| nickel sulfate | 18 g/l |
| sodium tungstate | 90 g/l |
| ammonium citrate | 90 g/l |
| tetraethyl 5-decyne 4,7 diol ethoxylated with 30 moles ethylene oxide* | 65 mg/l |

*Surfynol 485 from Air Products and Chemicals, Inc. 7201 Hamilton Blvd. Allentown, PA, USA, 18195.

A deposit was electroplated from the solution a steel cathode at a current density of 60 ASF. The deposit plated from this solution gave an excellent ductile nickel tungsten deposit at 60 ASF. The deposit had a tungsten content of 35% by weight.

EXAMPLE III

An aqueous (1 liter) Cobalt-tungsten electroplating bath was prepared in accordance with Table III below.

TABLE III

| bath constituent | amount |
|---|---|
| cobalt sulfate heptahydrate | 40 g/l |
| citric acid | 60 g/l |
| sodium tungstate dihydrate | 50 g/l |
| ammonium carbonate | 27 g/l |
| butyne diol with 2 moles ethylene oxide | 5 mg/l |

The pH was adjusted to and maintained at 7.5 to 8 and the temperature of the bath was kept between 140°–160° F. A steel cathode was plated in this solution using a 1000 ml Hull Cell at 5 amps for 3 min. The deposit was found to be fine grained and bright from 1–150 ASF.

EXAMPLE IV

An aqueous Iron-Tungsten electroplating bath was prepared in accordance with the Table IV set forth below.

TABLE IV

| bath constituent | amount |
|---|---|
| ferrous sulfate heptahydrate | 10 g/l |
| citric acid | 60 g/l |
| sodium tungstate dihydrate | 50 g/l |
| ammonium carbonate | 27 g/l |
| propargyl alcohol with 2 moles ethylene oxide | 10 mg/l |

The pH was adjusted to and maintained between 7.5 and 8.5 and the temperature maintained between 140° and 160° F. during electroplating. A steel cathode was plated in this solution at 5 amps, for 3 min. using a 1000 ml Hull Cell. The deposit was found to be commercially acceptable in the range of 1–150 ASF.

While the above specification and exemplification were given for purposes of disclosing the preferred embodiment of the present invention it is not to be construed to be limiting of the present invention.

It will be readily appreciated by those skilled in the art that the present invention can be practiced other than as specifically stated. Thus, the invention may be subject to modification, variation and change without departing from the proper scope and fair meaning of the accompanying claims.

What is claimed is:

1. An aqueous electrolyte bath, for electroplating of a brightened tungsten alloy, comprising:

an effective amount of tungsten ions;

an effective amount of a metal ion compatible with electroplating an alloy with tungsten from the electrolyte bath, selected from the group consisting of nickel, cobalt, iron and mixtures thereof;

one or more complexing agents; and an effective amount of a bath soluble alkoxylated hydroxy alkyne for providing brightening of a tungsten alloy electroplate plated from the electrolyte bath.

2. The electrolyte bath of claim 1 wherein the alkoxylated hydroxy alkyne has the formula:

$$(R_1)_x\text{---}C{\equiv}C\text{---}(R_2)_y$$

wherein $R_1$=H, an alkyl group or an alkoxy alcohol $R_2$=H, an alkyl group or an alkoxy alcohol and at least $R_1$ or $R_2$ is an alkoxy alcohol containing 1–4 carbon moieties including mixtures of these moieties which are included in ranges of from 1–100 moles of the alkoxy x or alkoxy y or 1–100 moles of each of alkoxy x and alkoxy y.

3. The electrolyte bath of claim 1 wherein the alkoxylated hydroxy alkyne is selected from the group consisting of: alkoxylated butyne diols, alkoxylated propargyl alcohols, alkoxylated dodecynediols, alkoxylated octyne mono or di alcohols, alkoxylated tetramethyl decyne diol, alkoxylated di methyl octyne diol and mixtures thereof.

4. The electrolyte bath of claim 1 wherein the alkoxylated hydroxy alkyne has the formula:

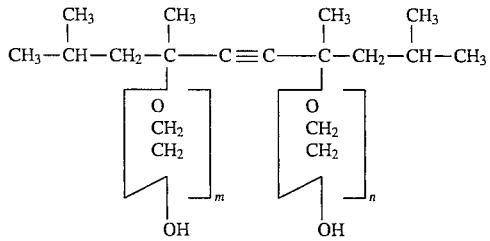

wherein m+n is selected to be at least a number of moles of ethylene oxide effective to provide solubility in the electrolyte.

5. The electrolyte bath of claim 4 wherein m+n is from about 10 to about 100.

6. The electrolyte bath of claim 4 wherein m+n equals about 30.

7. The electrolyte bath of claim 1 wherein the effective amount of the alkoxylated hydroxy alkyne is from about 1 mg/l to about 10 g/l.

8. The electrolyte bath of claim 4 wherein the effective amount of the alkoxylated hydroxy alkyne is from about 3 mg/l to about 1 g/l.

9. The electrolyte bath of claim 1 wherein the effective amount of the alkoxylated hydroxy alkyne is from about 5 mg/l to about 500 mg/l.

10. An aqueous electrolyte bath, for electroplating of a brightened tungsten alloy, comprising:

an effective amount of tungsten ions;

an effective amount of a metal ion compatible with electroplating an alloy with tungsten from the electrolyte bath said metal ion selected from the group consisting of nickel, cobalt, iron and mixtures thereof;

one or more complexing agents; and an effective amount of a brightening agent selected from the group consisting of: alkoxylated butyne diols, alkoxylated propargyl alcohols, alkoxylated dodecynediols, alkoxylated octyne mono or di alcohols, alkoxylated tetramethyl decyne diol, alkoxylated di methyl octyne diol and mixtures thereof.

11. The electrolyte bath of claim 10 wherein said effective amount of said brightening agent is from about 1 mg/l to about 10 g/l.

12. The electrolyte bath of claim 10 wherein said effective amount of said brightening agent is from about 3 mg/l to 1 g/l.

13. The electrolyte bath of claim 10 wherein said effective amount of said brightening agent is from about 5 mg/l to 500 mg/l.

14. The electrolyte bath of claim 10 wherein said alkoxylated tetramethyl decyne diol has the formula:

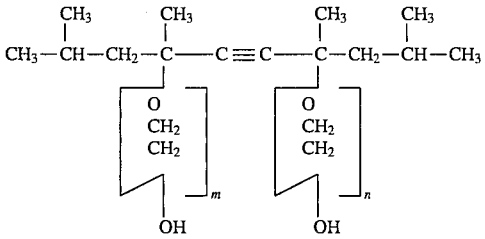

wherein m+n is selected to be at least a number of moles to provide solubility of the brightening agent in the bath.

15. The electrolyte bath of claim 14 wherein said effective amount of said brightening agent is from about 1 mg/l to about 10 g/l.

16. The electrolyte bath of claim 14 wherein said effective amount of said brightening agent is from about 3 mg/l to about 1 g/l.

17. The electrolyte bath of claim 14 wherein said effective amount of said brightening agent is from about 5 mg/l to about 500 mg/l.

18. A method for electroplating of a tungsten alloy electroplate comprising:

providing a tungsten alloy electrolyte which includes an effective amount of tungsten ions, an effective amount of a metal ion compatible for electroplating an alloy with tungsten from the electrolyte bath said metal ion selected from the group consisting of nickel, cobalt, iron and mixtures thereof; one or more complexing agents and an effective amount of a bath soluble alkoxylated hydroxy alkyne brightening agent; and electroplating a bright tungsten alloy coating onto a substrate from said bath.

19. The method of claim 18 wherein the alkoxylated hydroxy alkyne is selected from the group consisting of: alkoxylated butyne diols, alkoxylated propargyl alcohols, alkoxylated dodecynediols, alkoxylated octyne mono or di alcohols, alkoxylated tetramethyl decyne diol, alkoxylated di methyl octyne diol and mixtures thereof.

20. The method of claim 18 wherein the alkoxylated hydroxy alkyne has the formula:

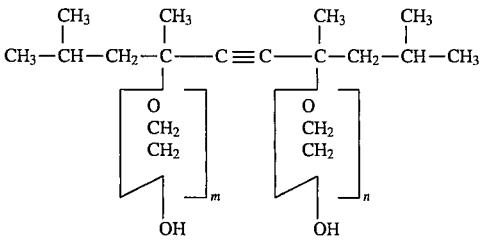

wherein m+n is from about 10 to about 100.

* * * * *

UNITED STATES PATENT AND TRADEMARK OFFICE

CERTIFICATE OF CORRECTION

PATENT NO. : 5,525,206

DATED : June 11, 1996

INVENTOR(S) : Walter J. Wieczerniak, et al.

It is certified that error appears in the above-indentified patent and that said Letters Patent is hereby corrected as shown below:

Column 1, Line 7, "Tungsten" should be --tungsten--.

Column 4, Line 9, "parts" should be --parts,--.

Column 4, Line 63, after "solution" insert --onto--.

Column 5, Line 3, "Cobalt-tungsten" should be --cobalt-tungsten--.

Column 5, Line 24, "Iron-Tungsten" should be --iron-tungsten--.

Signed and Sealed this

Twenty-fourth Day of December, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,525,206

DATED : June 11, 1996

INVENTOR(S) : Walter J. Wieczerniak, et al.

It is certified that error appears in the above-indentified patent and that said Letters Patent is hereby corrected as shown below:

ON TITLE PAGE, item [75], "Sylva" should be --Sylvia--.

Signed and Sealed this

Seventeenth Day of August, 1999

*Attest:*

Q. TODD DICKINSON

*Attesting Officer*

*Acting Commissioner of Patents and Trademarks*